United States Patent [19]

Di Paula, Jr. et al.

[11] 3,996,580

[45] Dec. 7, 1976

[54] FIRE ALARM AND PROTECTION BOOTH

[75] Inventors: Vincent Di Paula, Jr., Randallston; Joseph L. Casseri, Baltimore, both of Md.

[73] Assignee: Fire Alarm Marketing Corporation, Towson, Md.

[22] Filed: June 24, 1974

[21] Appl. No.: 482,422

Related U.S. Application Data

[63] Continuation of Ser. No. 379,915, July 17, 1973, abandoned.

[52] U.S. Cl. ..... 340/304; 340/297; 317/141 R

[51] Int. Cl.[2] ..... G08B 25/00

[58] Field of Search ..... 340/304, 297, 272, 301, 340/286; 317/123, 141 R

[56] References Cited

UNITED STATES PATENTS

| | | | |
|---|---|---|---|
| 790,822 | 5/1905 | Davenport | 340/304 X |
| 934,878 | 9/1909 | Bajtebo | 340/304 |
| 2,071,060 | 2/1937 | Bridges | 340/297 |
| 2,769,166 | 10/1956 | Seckendorf | 340/304 |
| 3,531,794 | 9/1970 | Goerner | 340/297 |
| 3,886,536 | 5/1975 | Mann | 340/304 |
| 3,886,537 | 5/1975 | Mann et al. | 340/304 |

*Primary Examiner*—John W. Caldwell
*Assistant Examiner*—William M. Wannisky

[57] ABSTRACT

A fire alarm and protection enclosure in the form of a booth or box having means therein for signalling an alarm to a fire station and/or police station. The enclosure includes a door and a treadle upon which a person must stand and close the door which is then automatically locked upon actuating the alarm, which door remains locked to detain the person setting off the alarm for a predetermined period. Electrical interlock circuitry interconnected with the door, the treadle and the door lock renders the apparatus fool-proof or tamperproof so that false alarms are prevented.

18 Claims, 2 Drawing Figures

FIRE ALARM AND PROTECTION BOOTH

This is a continuation of application Ser. No. 379,915, filed July 17, 1973, now abandoned.

BACKGROUND OF THE INVENTION

Field of the Invention

This invention generally relates to means for signalling an alarm to a central station from a remote station, such as a fire alarm box, and more particularly to a fire alarm and protection box comprising a booth having doors adapted to be locked when the alarm is actuated. The booth may be used not only for fire alarms, but also for police calls.

While the prior art generally discloses the concept of detaining a person in a fire alarm booth either for a short time delay or until someone releases the person from the box after an alarm has been actuated, such apparatus has suffered from being susceptible to tampering whereby false alarms could easily be set off. This problem of false alarms currently poses a particularly agonizing and frustrating situation for police and fire officials.

SUMMARY

Briefly, the subject invention comprises a booth type alarm and protection apparatus, for signalling an alarm to a central station, including an enclosure having a door adapted to be automatically locked for detaining a person upon actuating an alarm signalling device inside of the enclosure. The enclosure additionally includes a floor treadle and first switch means operated thereby, second switch means operable in accordance with the opening and closing of the enclosure door, a door lock, and third switch means operable by the door lock. In addition to alarm actuator means, the aforementioned switch means are coupled to a plurality of electrically operated relays selectively interconnected to provide tamper-proof operation such that an alarm signal can be provided only in the event that certain conditions are met, for example, a person standing on the floor treadle with the door closed and not having previously continuously operated the alarm actuator while the door was open and/or placing a weight of some type on the floor treadle in an attempt to defeat the system and produce a false alarm.

DESCRIPTION OF THE PREFERRED EMBODIMENT

Figure 1:
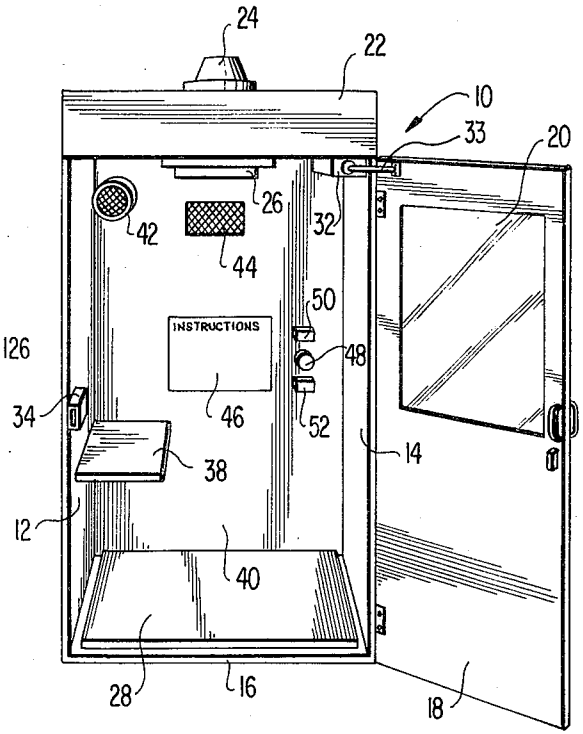
FIG. 1 is a perspective view of a fire and/or police alarm and protection booth, being illustrative of the preferred embodiment of the subject invention.

Referring now to the drawings, and more particularly to FIG. 1, reference numeral 10 designates an enclosure in the form of a booth permitting a person to stand or sit inside thereof. The booth 10 is comprised of side walls 12 and 14, a floor 16, and a door 18 having a shatter and/or bullet proof window 20. The ceiling portion 22 of the booth 10 is adapted to contain most of the electrical circuitry shown in FIG. 2, as well as having a rotating beacon light 24 mounted on the outside thereof. On the inside of the booth 10 there is mounted an overhead electrical light 26 which is adapted to be turned on when a person enters the booth. When desirable, however, since the booth is selectively located at one or more stations in a neighborhood for actuating a fire alarm and/or communicating an alarm signal to the police department, the booth 10 may also be utilized as a protection box or enclosure against personal attack, in which case it might be desirable to have the overhead electrical light turned on in conjunction with the surrounding street lights at dusk and remaining continuously on when the booth is not in use. The present embodiment of the subject invention, however, will be considered in terms of the overhead light 26 being turned on when a person opens the door 18 and steps inside.

Figure 2:
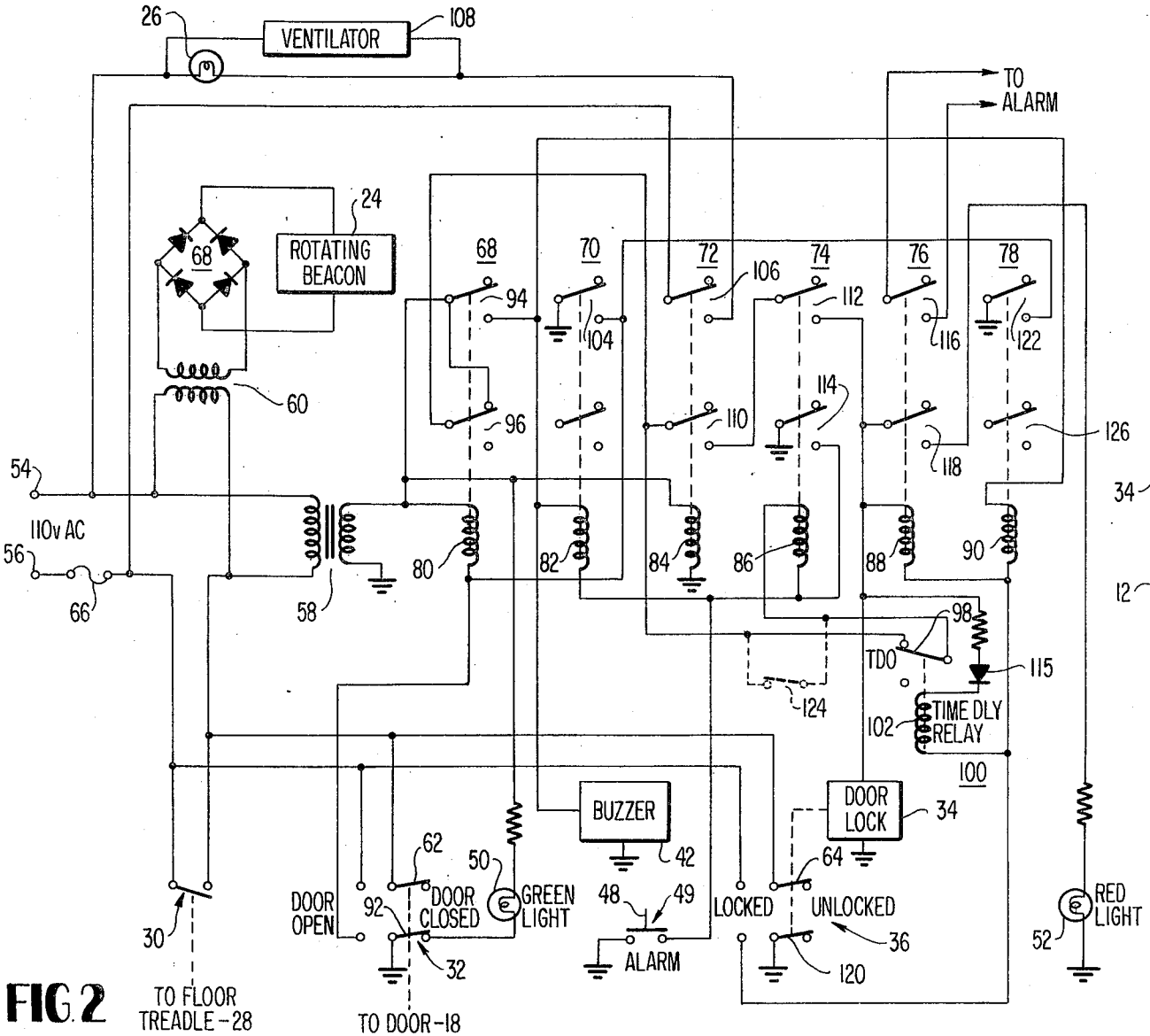
FIG. 2 is an electrical schematic diagram illustrative of the electrical circuitry for operating the booth shown in FIG. 1.

The booth 10 additionally includes a floor treadle 28 which is adapted to actuate a switch 30 shown in FIG. 2 only. A door operated electrical switch 32 shown in FIG. 1 is mounted on the upper portion of the side wall 14 in the vicinity of the ceiling portion 22. This switch can only be operated by the door due to the mechanical coupling 33. An electrically operated lock 34 for the door 18 is also mounted on the side wall 12 and is adapted to operate a third electrical switch 36 shown in FIG. 2. A seat 38 is provided merely for the sake of convenience, and is shown secured to the side wall 12 and to the back wall 40. An electrical buzzer 42 or other like auditory device is shown mounted on the rear wall 40 as well as a ventilator screen 44 covering ventilator apparatus, not shown. An instruction plate 46, containing operating instructions is also mounted on the rear wall 40 adjacent an "alarm" push-button 48 for a push-button switch, not shown, and a green and red indicator light 50 and 52, respectively.

In operation, a person wishing to signal an alarm or make use of the protective features provided by the subject invention enters the booth 10 and closes the door 18, while stepping on the treadle 28. When the door 18 is shut, the green light 50 will come on indicating readiness of the apparatus. The push-button 48 is then pushed, which if the proper conditions for tamper-proof operation are met, an alarm either locally and/or remotely will be actuated and the red light 52 will become lit. Additionally, the door lock 34 will become activated and will be maintained in the locked state for a predetermined time interval, five seconds to three minutes, after which time the lock will be released, the red light 52 will go out and a person utilizing the booth 10 may then open the door and exit.

The electrical circuitry for providing not only safe operation but also fool-proof or tamper-proof operation is shown in FIG. 2. Referring now to FIG. 2, terminal 54 and 56 comprise AC power input terminals for coupling AC power line potential to the primary windings of transformers 58 and 60. The primary winding circuit of the transformers 58 and 60 are normally open circuited by means of the floor treadle switch 30, one section 62 of the double-pole, double-throw switch 32, which is adapted to be actuated by the door 18 and one section of a double-pole double-throw switch 36 which is adapted to be operated by the door lock 34. The switches 30, 62 and 64 are parallely conected in series with the primary winding circuit additionally including the fuse 66. Thus when either the door 18 is opened and/or locked or there is a weight on the floor treadle 28, AC line voltage will be applied to the transformers 58 and 60. The secondary winding of transformer 60 is coupled to a bridge rectifier arrangement 68 which is adapted to power the rotating beacon 24 shown in FIG.

1 on top of the booth 10. Thus for example, the rotating beacon is activated whenever one opens the door 18 and enters the booth 10.

The power transformer 58 comprises a step-down AC transformer for providing the necessary voltage for operating and controlling the operation of the subject invention. One side of the secondary winding of transformer 58 is returned to ground while the other side is connected to six electrical relays 68, 70, 72, 74, 76 and 78. The relays each include two sets of contacts as shown in their normally inoperative state but are adapted to be actuated by respective relay coils 80, 82, 84, 86, 88 and 90.

The relays and the associated devices are connected in the following manner. Considering first relay 68, one side of the relay coil 80 is coupled to the secondary winding of transformer 58 while the other side is connected to the other switch section 92 of the door operated switch 32 and is adapted to be grounded when the door 18 is opened. The fixed contact of one set of relay contacts 94 is coupled to the secondary winding of transformer 58 and to the normally closed contacts of the other set of contacts 96 of the relay 68. The relay coil 82 of relay 70 is connected to the normally open contacts of relay contacts 94 while the opposite side is connected to one contact of the alarm push-button switch 49. The normally open contacts 94 are also connected to the buzzer 42 or some such auditory device as well as to one side of the relay coil 90. The fixed contact of the relay contacts 96 is connected through a set of normally closed relay contacts 98 of a time delay relay 100 which is adapted to open the relay contacts 98 after a predetermined time (5 sec. - 3 min.) after its relay coil 102 is energized.

Referring now to the relay 70, one set of relay contacts is unused, however, the other set 104 has its fixed contact returned to ground while the normally open contact is coupled to one side of the relay coil 80 for holding it at ground potential when relay contacts 104 are actuated. With respect to relay 72, the coil 84 has one side connected to the secondary winding of transformer 58 while the opposite side is returned to ground. Thus the relay coil 84 is adapted to be energized whenever power is applied to the primary winding of transformer 58. One set of relay contacts 106 has its fixed contact and normally open contact coupled to the overhead light 26 and the ventilator means 106 such that when the booth is occupied, the overhead light 26 and the ventilator 106 will be turned ON. The other set of relay contacts 110 has its fixed contact coupled back to the fixed contact of relay contacts 96 for receiving the AC potential appearing across the secondary winding of transformer 58 whenever relay 68 is unenergized such as when the door is closed. The normally open contact of relay contacts 110 is connected to the fixed contact of one set of relay contacts 112 which are actuated by means of relay coil 86 for relay 74 and having one side coupled to the normally closed contacts 98 of the time delay relay 100 while the opposite side is connected to the alarm push button 49. The second set of contacts 114 of the relay 74 has its fixed contact connected to ground while the normally opened contact is coupled to the ground side of the relay coil 86 and is adapted to provide a holding function for the relay 74 when activated.

Relay 74 when activated is adapted to energize the door lock 34 through the relay contacts 112 and additionally energize relay coil 86 of relay 76 and relay coil 102 of the time delay relay 100. The diode 115 prevents a sneak circuit from energizing the relay. The first set of contacts 116 of relay 76 is coupled to an alarm device located remotely and/or locally and is adapted to be actuated when the relay contacts 116 are closed. The other set of relay contacts 118 has its fixed contact coupled to the normally opened contact of relay contacts 112 and is adapted to energize the red indicator light 52 when the alarm relay 76 is energized and an alarm is actuated by the relay contacts 116. With respect to the sixth relay 78, the relay coil 90 has one side coupled back to the normally opened contact of relay contacts 94 of the relay 68 while its opposite side is adapted to be coupled to ground through the switch contacts 120 of the double-pole double-throw lock activated switch 36. One set of relay contacts is unused; however, the other set of relay contacts 122 have the fixed contact returned to ground while the normally opened contact thereof is connected back to the ground side of the relay coil 80 of relay 68.

Considering the operation of the circuitry shown in FIG. 2, relay 74 might be referred to as the door lock relay whereas relay 76 might be referred to as the alarm relay. The first relay 68 constitutes a lock-out relay while relays 70 and 78 might be referred to as interlock relays for the prevention of tampering or some other attempt to defeat intended operation so that false alarms are prevented. When the booth 10 is unoccupied and the door 18 is closed, switches 30, 62 and 64 will be in the position as shown, and the entire apparatus will be inoperative. Assuming now that one wishes to activate the alarm and/or seek refuge from a would-be attacker, the door 18 would be opened, at which time switch 32 would be activated. Switch sections 62 and 92 thereby become closed and power is applied to the transformer 58, whereupon relay 72 is energized, causing the overhead light 26 and the ventilator 108 to become energized. At the same time, relay coil 80 is returned to ground through switch contacts 92 of the door actuated switch 32 whereupon the normally open relay contacts 94 close while the normally closed relay contacts 96 open. The closure of relay contacts 94 sounds the buzzer 42 and applies AC potential to one side of relay coils 82 and 90 of relays 70 and 78. The opening of relay contacts 96, however, locks out the AC voltage appearing on the secondary winding of transformer 58 from being coupled to relays 74 and 76. After the person enters the booth and closes the door, the floor treadle 28 closes the switch 30 and thereby maintains an uninterrupted circuit for the transformers 58 and 60. Concurrently, the green indicator light 50 is turned ON through the switch contacts 92 of the door activated switch 32. Switch contacts 62 and 92 meanwhile reopen causing relay 68 to deenergize. The reclosure of relay contacts 96 now permits the AC voltage appearing on the secondary winding of transformer 58 to be coupled to relay coil 86 through the normally closed time delay relay contacts 98.

Next pressing the alarm push-button 48 causes the push-button switch 49 to close whereupon relay coil 86 is grounded, causing it to energize. The closure of the normally open relay contacts 114 will hold the relay 74 in an energized state until either the AC voltage is removed or the time delay relay 100 is activated. As relay 74 becomes energized, normally open relay contacts 112 close, causing the AC voltage appearing on the secondary winding of transformer 58 to be applied to the door lock 34. Actuation of the lock 34 causes the double-pole double-throw switch 36 to be energized, grounding the relay coils 88, 90 and 102 through switch contacts 120. Thus power is applied to the respective control relays until the door is subsequently unlocked making it thereby impossible to turn off the power if the person, for example, were to jump off the threadle 28 or somehow remove his weight therefrom. Grounding the relay coil 88 actuates relay 76, causing the alarm apparatus to be activated by closure of the normally open switch contacts 116. Closure of normally open relay contacts 118, on the other hand, merely activates the red indicator light 52. Since relay coil 86 of relay 74 is energized through the time delay relay contacts 98, switching of relay contacts 112 causes the time delay relay coil 102 to become energized via diode 115, which after a predetermined time delay, such as 5 seconds to 3 minutes, normally closed relay contacts 98 will become opened, at which time relay coil 86 becomes deenergized and the door lock 34 becomes deactivated and the switch 36 reverts to the unactivated state shown in the drawing. The red light 52 again turns OFF indicating that the person is free to leave the booth by opening the door 18.

The foregoing description indicates that under normal circumstances the relay 68 normally prevents activation of the door lock 34 and the alarm circuitry while the door 18 is open, due to the action of the set of relay contacts 96. Considering now the situation where one attempts to defeat the system by pressing the alarm push button 48 while the door 18 is open, closure of push button switch 49 grounds relay coil 86, however, relay contacts 96 of the lock out relay 68 are open, and therefore no alarm could be actuated. If for example one tapes the push-button 48 in a closed position wherein the push-button switch 49 is continuously closed and then the door 18 is closed, closure of switch 49 grounds relay coil 82 of the interlock relay 70 causing switch contacts 104 to close, which in turn grounds relay coil 80 causing it to be energized even when the door is closed and if, for example, a weight were applied to the treadle 28 causing switch 30 to be in a closed position. Without the action of the relay contacts 104, the latter condition would cause an alarm to be otherwise provided and the door locked.

Secondly, consider an attempt to overcome the action of the lock-out relay 68 when the door is open and where a switch 36 is tampered with. For example with the door 18 open, if one compromises the switch 36 causing the switch sections 64 and 120 to assume the locked position, pressing of the alarm push-button 48 would ordinarily activate the alarm circuitry by closure of the switch contacts 64; however, relay coil 90 becomes energized causing relay contact 122 to ground relay coil 80 of the lock out relay 68 which then opens switch contacts 96, thereby preventing an alarm from being activated.

While the present embodiment has been considered thus far in view of the time delay relay 100 holding the door lock 34 for a predetermined time period after being energized in the event of a true alarm being generated by operation of the circuitry shown in FIG. 2, when desirable, the time delay relay 100 can be replaced or supplemented with an externally controlled lock switch 124 shown in phantom view so that a person utilizing the apparatus is detained until released from the outside. The switch 124 may then be comprised of a key operated switch or some such device. Additionally, the switch 124 may also be included in combination with the time delay relay 100 for use in the event that the relay 100 becomes inoperative such that the relay contacts 98 cease to open after their predetermined time period.

Also a voice communication system can be provided as an option when desired so that an individual in the booth can speak directly to the authorities. This could be accomplished, for example, by the use of the presently unused set of relay contacts 126 associated with relay 78.

Having thus described what is at present considered to be the preferred embodiment of the subject invention,

We claim:

1. A station for signalling an alarm to fire and/or police departments while preventing the possibility of actuating false alarms, as well as providing an emergency refuge, comprising in combination:

a booth type enclosure (10), including a lockable door (18) adapted to detain the person in the enclosure for a predetermined time period after actuating an alarm signal, and additionally including weight responsive means (28) located in the bottom portion of the booth;

first switch means (30) actuable by said weight responsive means (28), second switch means (32) actuated by the opening and closing of said door, an electrical operated door lock (34), third switch means (36) actuated by said door lock, and fourth switch means (49) for actuating an alarm signal;

first electrical circuit means (58) selectively coupled to an electrical power source by the operation of any one of said first, second, and third switch means to provide an electrical power potential;

second electrical circuit means coupled to said power potential and including a first relay (68) coupled to and operated by said second switch means (32) when said door is open, said relay (68) including a set of relay contacts (96) having a normally first of first and second operating states coupled to said power potential;

third electrical circuit means coupled to said power potential by means of said set of relay contacts (96) of said first relay, and including a second electrical relay (74) and a pair of selectively operated contacts (98) having a normally first of first and second operating states, said second relay (74) being operated by the operation of said fourth switch means (49) and said pair of electrical contacts (98) in said first operating state, said second relay additionally including a set of relay contacts (112) having a normally second of first and second operating states coupled to said set of relay contacts (96) of said first relay (68);

said door lock (34) being coupled to said set of contacts (112) of said second relay (74) and being energized upon the operation of said relay contacts (112) to actuate said third switch means (36);

forth electrical circuit means coupled to said power potential by means of said set of relay contacts (112) of said second relay (74) and including a third electrical relay (76) coupled to and operated by the actuation of said third switch means (36) together with the operation of said set of contacts (112) of said second relay, said third relay additionally including a set of relay contacts (116) having a normally second of first and second operating states and becoming operable to signal an alarm upon the operation of said third relay (76); and fifth electrical circuit means coupled to said power potential by means of said first relay (68) when operated and including a fourth electrical relay (70) operated by said fourth switch means (49) and including a set of relay contacts (104) having a normally second of first and second operating states, becoming operable to hold said first relay operative (68) when said door is closed in the event said fourth switch means (49) is continuously operated prior to door closure; and sixth electrical circuit means coupled to said power potential by means of said set of relay contacts (94) said first relay (68) when operated and including a fifth electrical relay (78) operated by said third switch means (36) and including a set of relay contacts (122) operable to hold said first relay operative (68) when said third switch means (36) is activated by means other than said door lock (34).

2. The station as defined by claim 1 wherein said normally first of said two operating states of relay contacts comprises the normally closed state and said normally second of said two operating states comprises the normally open state.

3. The station as defined by claim 2 and additionally including a sixth electrical relay (72) coupled to said first electrical circuit means and being operated by said electrical power potential and including a set of normally open relay contacts (110) coupled between said set relay contacts (112) of said second electrical relay (74) and said set of relay contacts (94) of said first electrical relay (68).

4. The station as defined by claim 3 wherein said pair of electrical contacts (98) recited in said third electrical circuit means comprises relay contacts of a time delay relay (100) operated by said third switch means (36) and adapted to open said relay contacts (98) after a predetermined time delay.

5. The station as defined by claim 3 wherein said electrical contacts recited in said third electrical circuit means comprises a normally closed electrical switch (124) located externally of said booth.

6. The station as defined by claim 1 wherein said first electrical circuit means comprises a transformer (58) having a primary and secondary winding and wherein said first (30), second (62) and third switch means (64) are parallely connected in series between said primary winding and said power source.

7. The station as defined by claim 6 and additionally including a second transformer (60) having a primary winding coupled across the primary winding of transformer (58) and having a secondary winding adapted to energize means indicating the presence of a person in said booth.

8. The station as defined by claim 7 and additionally including indicating means comprising a visual beacon located on said booth coupled to the secondary winding of said second transformer.

9. The station as defined by claim 1 wherein said weight responsive means (28) comprises a floor treadle.

10. The station as defined by claim 1 wherein said first relay (68) additionally includes a second set of relay contacts (94) having a normally second of first and second operating states, an auditory signalling device (42) coupled to said second set of relay contacts (94) and being energized thereby when said door (18) is opened; and wherein said sixth electrical relay (72) includes a second set of relay contacts (106) having a second of first and second operating states and interior lighting means coupled to said set of relay contacts and being turned on thereby when said power potential is supplied by said first electrical circuit means.

11. A station for signalling an alarm to fire and/or police departments while preventing the possibility of actuating false alarms, as well as providing an emergency refuge, comprising in combination:

a booth type enclosure (10) including a door (18) having an electrically operated door lock (34);

electrical control circuit means (68–78) adapted when enabled and actuated to signal an alarm to a remote location and energize said electrically operated door lock to temporarily detain a person entering said enclosure for a predetermined time period following actuation and thereafter automatically deenergizing said electrically operated door lock to release said person;

door switch means (32) coupled to said electrical control circuit means and being actuated by the opening and closing of said door and being operable to disable said control circuit means when said door is open;

weight responsive switch means (30) coupled to said electrical control circuit means and being located in the bottom portion (16) of said enclosure and being responsive to the person's weight and operated thereby, being operable simultaneously with said door switch means when said door is closed to enable said electrical control circuit means;

an alarm switch (49) coupled to and operative to actuate said electrical control circuit means following enablement to operate said electrically operated door lock and signal an alarm;

said electrical control circuit means additionally including automatic electrically operated holding circuit means (100) coupled to the door lock for maintaining energization of said door lock to provide a locked condition for said predetermined detention time period following enablement of said control circuit means and subsequent operation of said alarm switch and thereafter automatically deenergizing said door lock to provide an unlocked condition following said detention time period; and door lock actuated switch means (36) coupled to said electrically operated holding circuit (100), being operable upon operation of said door lock to actuate said holding circuit.

12. The station as defined by claim 11 wherein said holding circuit comprises time delay circuit means.

13. The station as defined by claim 11 and additionally including an auditory signalling device (42) being responsive to the operation of said door switch means (32) and becoming energized when said door is open to provide a local auditory signal.

14. The station as defined by claim 11 and additionally including a visual beacon (24) located on said booth, being responsive to both the operation of said door switch means (32) and said weight responsive switch means (30) to become energized to indicate usage of said booth type enclosure.

15. The station as defined by claim 11 wherein said control circuit means includes alarm circuit means (76).

16. The station as defined by claim 15 wherein alarm circuit means includes external-alarm actuator means (116) and means (88) coupled to and responsive to the operation of said door lock actuated switch means (36) to operate said external-alarm actuator means.

17. The station as defined by claim 11 wherein said alarm switch (49) comprises a momentarily actuated push-button switch.

18. The station as defined by claim 11 wherein said booth type enclosure includes a floor treadle (28) and wherein said weight responsive switch means (30) is activated by said floor treadle.

* * * * *